US005987719A

United States Patent [19]

Cooper

[11] Patent Number: 5,987,719

[45] Date of Patent: Nov. 23, 1999

[54] TAMPER RESISTANT PLASTIC FASTENER

[75] Inventor: William J. Cooper, Woonsocket, R.I.

[73] Assignee: Avery Dennison Corporation, Pasadena, Calif.

[21] Appl. No.: 08/438,512

[22] Filed: May 11, 1995

Related U.S. Application Data

[63] Continuation of application No. 08/084,356, Jun. 28, 1993, abandoned.

[51] Int. Cl.[6] ..... A44B 9/02

[52] U.S. Cl. ..... 24/711.1; 24/16 PB; 206/343

[58] Field of Search ..... 24/711.1, 16 PB, 24/17 AP, 298, 302; 206/343

[56] References Cited

U.S. PATENT DOCUMENTS

| | | | |
|---|---|---|---|
| Re. 32,332 | 1/1987 | Kato | 24/711.1 X |
| 3,080,630 | 3/1963 | Paliotta . | |
| 3,103,666 | 9/1963 | Bone . | |
| 3,765,110 | 10/1973 | Olsen | 24/711.1 X |
| 4,121,487 | 10/1978 | Bone . | |
| 4,347,932 | 9/1982 | Furutu . | |
| 4,456,161 | 6/1984 | Russell . | |
| 4,586,609 | 5/1986 | Won | 24/711.1 X |
| 4,901,854 | 2/1990 | Bone et al. | 24/711.1 X |

*Primary Examiner*—Laurie K. Cranmer
*Attorney, Agent, or Firm*—Kriegsman & Kriegsman

[57] ABSTRACT

Tamper resistant plastic fastener which may be used, among other things, to attach a tag to a desired article, such as a garment of clothing, a product label or the like. The fastener comprises an elongated unitary plastic member shaped to include a cross bar, a paddle, and a flexible filament interconnecting the cross bar and paddle. The cross bar is sufficiently small so that it cannot easily be manually aligned with the installation hole for removal therethrough.

3 Claims, 4 Drawing Sheets

TAMPER RESISTANT PLASTIC FASTENER

This is a continuation of application Ser. No. 08/084,356 filed on Jun. 28, 1993 now abandoned.

BACKGROUND OF THE INVENTION

The present invention relates generally to plastic fasteners and more particularly to a plastic fastener which, once attached to a desired item, cannot easily be removed therefrom intact.

Plastic fasteners are well known and widely used in the retail industry, e.g., to attach tags to articles of clothing. Typically, such fasteners comprise an elongated plastic member having a first end shaped to define a cross bar (also commonly referred to as a "T bar"), a second end shaped to define a paddle, and a thin filament portion interconnecting the cross bar and the paddle. The cross bar typically has a length of 0.25 inch or greater and is otherwise dimensioned for insertion first through a tag and then through a desired article. The paddle is appropriately dimensioned to keep a tag from being pulled off the second end of the fastener. Typically, such fasteners are mass produced by a molding process in either one of two different forms known as fastener stock. One type of fastener stock, which is shown in commonly assigned U.S. Pat. No. 3,103,666 and incorporated hereinto by reference, comprises a plurality of fasteners joined together at their respective cross bars by an orthogonally disposed runner bar. The other type of fastener stock, which is shown in commonly assigned U.S. Pat. No. 4,955,475 and incorporated hereinto by reference, comprises a plurality of fasteners arranged in an end to end alignment, the heads and opposite ends of successive fasteners being joined together by severable connectors so as to form a continuously connected fastener stock.

Typically, the cross bar portion of a single fastener is separated from a quantity of fastener stock and then inserted first through a tag and then through a sheet of material with a hand held apparatus commonly referred to as a tagging gun. (Connections, if any, between the paddles of a pair of adjacent fasteners are severed by pulling the tagging gun away from the piece of fabric after the cross bar of one of the fasteners has been inserted thereinto.) Examples of tagging guns are illustrated in commonly assigned U.S. Pat. Nos. 5,024,365, 4,121,487, and 4,456,161, all of which are incorporated hereinto by reference.

While plastic fasteners of the type described above function reasonably well to attach tags to clothing and the like, it is nonetheless known that certain unscrupulous consumers make it a practice to remove such fasteners intact from their respective items, only to later re attach the fasteners either to the same or to different items. One such practice of the type described above is commonly referred to as "ticket switching" and typically involves removing the fastener and tag from a low priced item and re attaching them to a high priced item. As can readily be appreciated, to remove and re attach the fastener to the high priced item, the fastener must be removed intact from the low priced item. Typically, such removal of the fastener is accomplished first by manipulating the cross bar so that one of its ends is aligned with the installation hole, i.e., the opening in the sheet of material through which the cross bar and filament were originally inserted, and then by pushing the cross bar and the filament back through the installation hole.

SUMMARY OF THE INVENTION

It is an object of the present invention to provide a new and improved plastic fastener.

It is another object of the present invention to provide a plastic fastener of the type described above which, once attached to a desired article, cannot easily be removed therefrom intact.

It is still another object of the present invention to provide a plastic fastener of the type described above which can be mass produced according to conventional techniques to form fastener stock of either the continuously connected variety or the runner bar variety and which can be dispensed using conventional tagging guns.

In furtherance of the objects broadly set forth above, such a fastener comprises an elongated filament and a cross bar disposed at one end thereof, said cross bar being insertable through a desired item and engageable with the opposite side thereof to retain the fastener thereon, said cross bar also being sufficiently short in length so that, once said cross bar has been inserted through an. installation hole in an item, an end thereof cannot easily be aligned with the installation hole in such a way as to permit said cross bar and said elongated filament to be withdrawn through the installation hole.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 2:
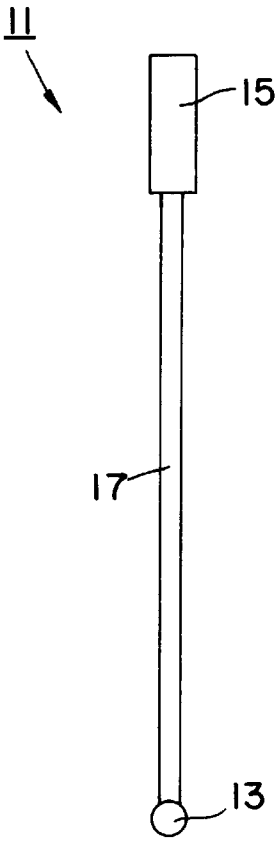
FIG. 2 PRIOR ART
FIG. 2 is a right end view of the plastic fastener shown in FIG. 1.
Figure 1:
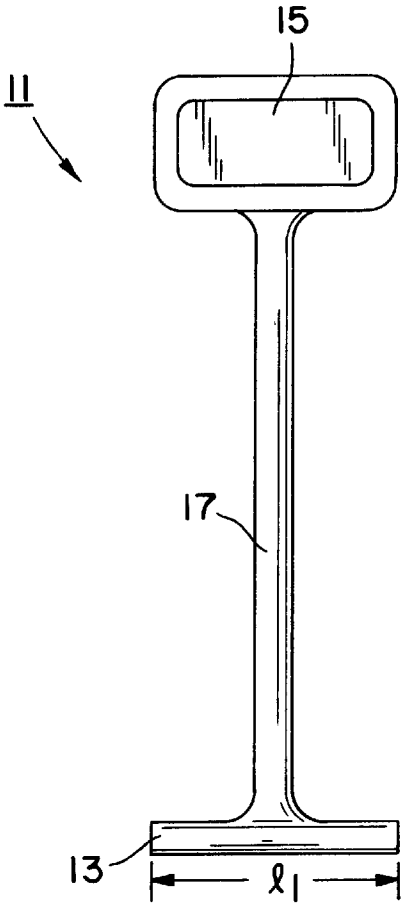
FIG. 1 PRIOR ART
FIG. 1 is a front view of a prior art plastic fastener.

Referring now to FIGS. 1 and 2, there is shown a prior art plastic fastener of the type which may be used, among other things, to attach a tag to a desired article, the prior art plastic fastener being represented generally by reference numeral 11.

Fastener 11 is an elongated unitary plastic member shaped to define a cross bar 13, a paddle 15, and a filament 17, filament 17 interconnecting cross bar 13 and paddle 15. Cross bar 13 has a length $l_1$ of at least 0.25 inch and is dimensioned for insertion through a tag and a desired article, preferably through the hollow slotted needle of a tagging gun. Paddle 15 is appropriately sized and shaped to prevent a tag positioned on filament 17 from being pulled thereover. As can readily be appreciated, fastener 11 may be molded as part of a quantity of either continuously connected fastener stock or fastener stock of the type having an orthogonally diposed runner bar.

Figure 3:
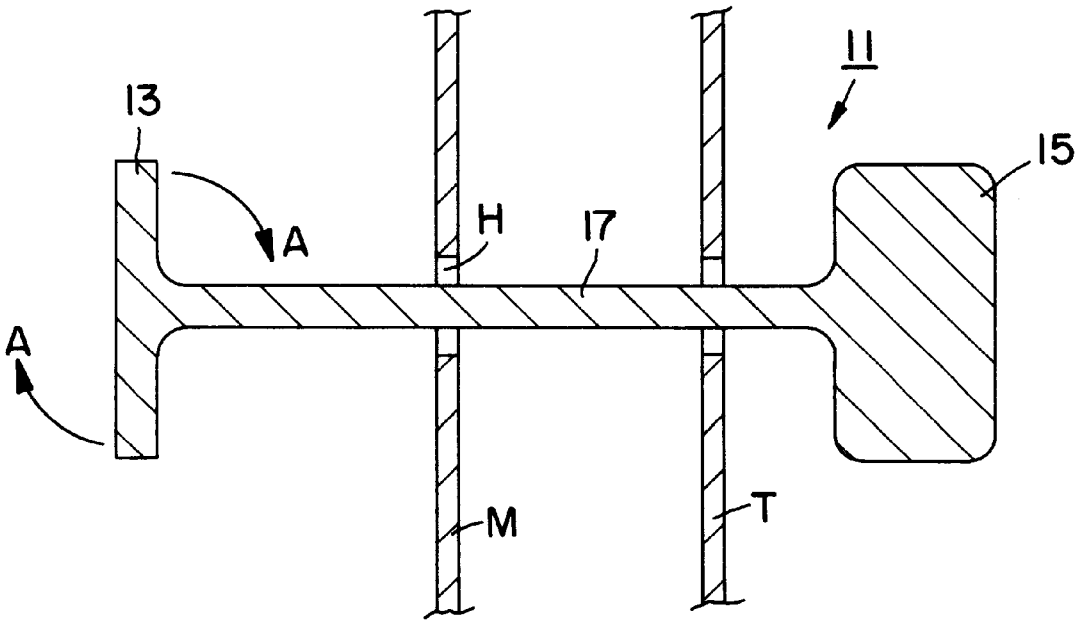
FIG. 3 is a section view illustrating how the cross bar of the plastic fastener shown in FIG. 1 can be manipulated so that an end thereof is aligned with an installation hole, thereby permitting the cross bar and filament to be withdrawn through the installation hole.

As discussed above and as illustrated in FIG. 3, one drawback to using fastener 11 to attach a tag T to a sheet of material M is that cross bar 13 can be easily manipulated manually so that one end thereof is aligned with an istallation hole H in the sheet of material M (e.g., by pivoting and/or bending cross bar 13 in the direction indicated by arrow, A), thereby permitting the withdrawal of cross bar 11 and filament 15 through installation hole H and the decoupling of fastener 11 from material M in a manner avoiding detection. (For purposes of the present specification and claims, an installation hole refers to either (1) a pre existing opening in a opening in a sheet of material which has been created by the insertion of a cross bar and filament therethrongh.)

Figure 5:
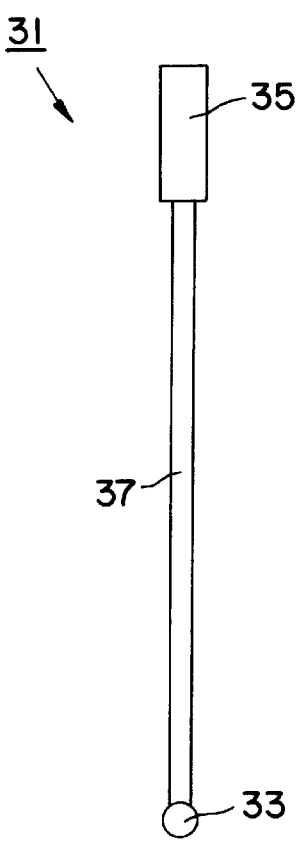
FIG. 5 is a right end view of the plastic fastener shown in FIG. 4.
Figure 4:
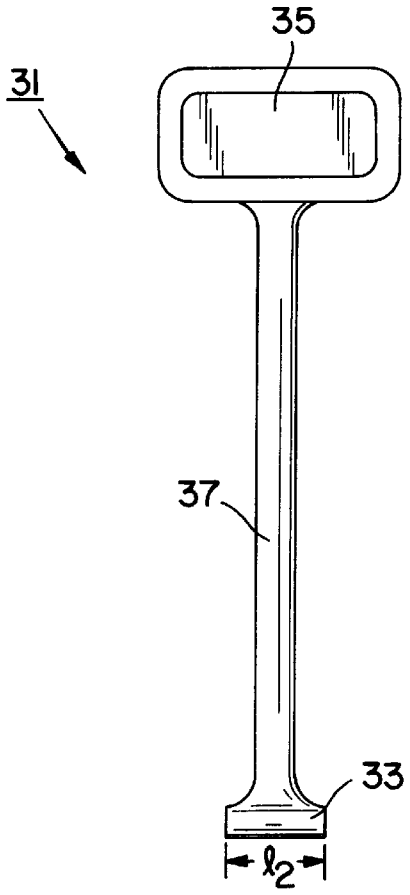
FIG. 4 is a front view of a plastic fastener constructed according to the teachings of the present invention.

Referring now to FIGS. 4 and 5, there is shown a plastic fastener constructed according to the teachings of the present invention, the plastic fastener being represented generally by reference numeral 31.

Figure 6:
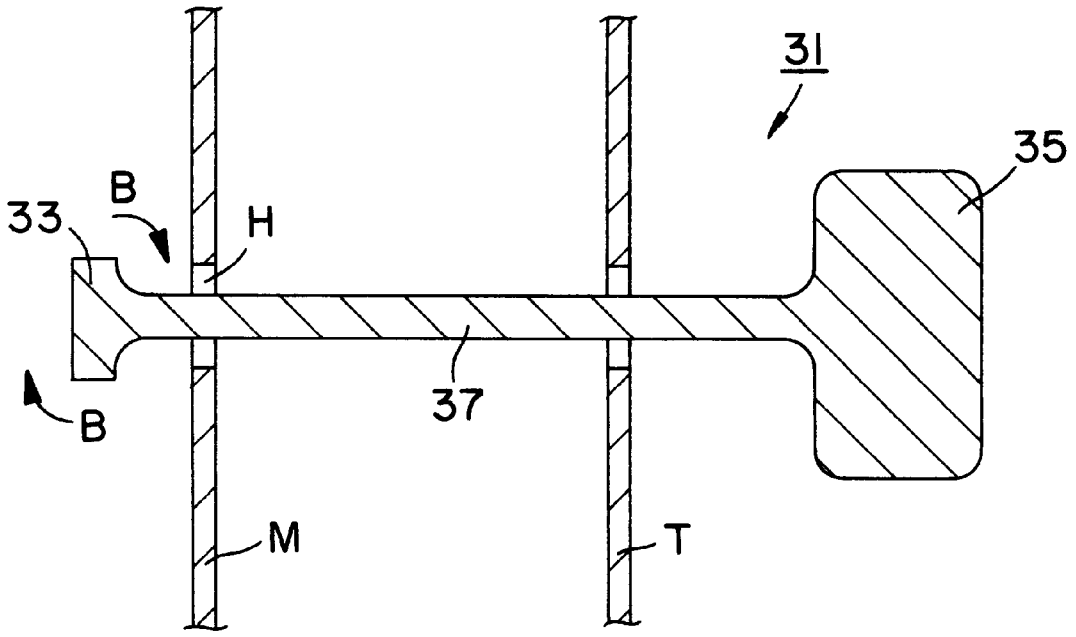
FIG. 6 is a section view illustrating how the shortened cross bar of the plastic fastener of FIG. 4 makes it significantly more difficult for someone to align an end thereof with an installation hole in such a way as to permit withdrawal of the cross bar and filament through the installation hole.

As can readily be seen, plastic fastener 31 is very similar in construction and composition to plastic fastener 11, plastic fastener 31 being an elongated unitary plastic member shaped to define a cross bar 33, a paddle 35, and a filament 37, filament 37 interconnecting cross bar 33 and paddle 35. Plastic fastener 31 differs from plastic fastener 11, however, in that cross bar 33 has a length $l_2$ of approximately 0.1 inch whereas, as noted above, fastener 11 has a length $l_1$ of 0.25 inch or greater. As illustrated in FIG. 6, because cross bar 33 is truncated, it is not as flexible and cannot as easily be manipulated manually so that one end thereof becomes aligned with hole H for withdrawal therethrough (e.g., by pivoting and/or bending cross bar 33 in the direction indicated by arrows B) as can be cross bar, 13 of fastener 11.

In addition to making intact removal of fastener 31 more difficult than is typically the case with fasteners like fastener 11, the shortened length of cross bar 33 also provides fastener 31 with certain other advantages over fasteners like fastener 11. One such advantage is the reduced insertion force needed to insert fastener 31 through an installation hole. This is because during insertion of a fastener like fastener 11 or fastener 31 through an installation hole, the filament portion of the fastener is typically bent over the rear half of the cross bar. This represents the widest section of the fastener that must be inserted through the installation hole. Clearly, by reducing the length of the cross bar and, therefore, the length of overlap between the cross bar and filament, the insertion force is also reduced.

Another advantage to fastener 31 resulting from the comparatively short length of cross bar 33 is enhanced toggling and, consequently, reduced non insertion. This is because when a conventional tagging gun is used to insert a fastener like fastener 11 into a sheet of material, the fastener is typically subjected to opposing forces, i.e., the ejector rod is pushing the cross bar down through the needle of the tagging gun while the filament is pulling the cross bar back up through the needle. When the filament reaches the exit point of the needle, it tries to pull the cross bar out of the needle. That portion of the cross bar still in the needle serves to keep the cross bar from exiting the needle until the ejector rod has pushed the tail end of the cross bar nearer to the needle exit point. This causes the fastener to bend at the filament/cross bar intersection and often results in non insertions. By shortening the distance from the filament/cross bar intersection to one end of the cross bar, toggling is enhanced and non insertion is reduced.

Still another advantage to fastener 31 resulting from the comparatively short length of cross bar 33 is the comparative ease with which fastener 31 may be manufactured. This is because fasteners like fastener 11 are typically made by molding. To remove the fastener from the mold, an ejector pin is used. The pin moves at least the distance of one half the cross bar length. Therefore, by reducing the length of the cross bar, this ejection distance is reduced, thereby simplifying removal of the fastener from the mold.

Still yet another advantage to fastener 31 resulting from the comparatively short length of cross bar 33 is its reduced weight and, in turn, reduced material cost.

Although the invention has been described with respect to plastic fasteners of the type commonly used to attach tags to sheets of material, it should be understood that the principles of the invention may be applied generally to any plastic fastener of the type having an elongated filament and a cross bar attached to at least one end of the elongated filament. Such plastic fasteners may include the well known and commonly used loop type fasteners, which are fired twice from a tagging gun and are used to loosely pair items together, to hang soft goods or to secure products to packaging.

The embodiment of the present invention recited herein is intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A fastener adapted for attachment to a sheet of material, said fastener comprising a unitary plastic member shaped to include an elongated filament having a cross bar at one end thereof, said cross bar being insertable through the sheet of material and engageable with the opposite side thereof to retain said fastener thereon, said cross bar being sufficiently short in length so that, once said cross bar has been inserted through an installation hole in the sheet of material, said cross bar cannot easily be manipulated in such a way as to be aligned with and withdrawn through the installation hole, said cross bar having a length of approximately 0.1 inch.

2. The fastener as claimed in claim 1 wherein said cross bar has a length of 0.1 inch.

3. The fastener as claimed in claim 1 wherein said unitary plastic member is shaped to include a single elongated filament, said cross bar being disposed at a first end of said single elongated filament and a paddle being disposed at a second end of said single elongated filament.

* * * * *